US010985482B2

(12) United States Patent
Jin

(10) Patent No.: US 10,985,482 B2
(45) Date of Patent: Apr. 20, 2021

(54) ELECTRICAL CONNECTOR HAVING REDUCED CROSSTALK WITH IMPROVED SIGNAL TRANSMISSION

(71) Applicant: LOTES CO., LTD, Keelung (TW)

(72) Inventor: Zuo Feng Jin, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 16/808,552

(22) Filed: Mar. 4, 2020

(65) Prior Publication Data

US 2020/0303854 A1 Sep. 24, 2020

(30) Foreign Application Priority Data

Mar. 22, 2019 (CN) ..... 201920376838.9

(51) Int. Cl.
*H01R 12/72* (2011.01)
*H01R 13/24* (2006.01)

(52) U.S. Cl.
CPC ..... *H01R 12/721* (2013.01); *H01R 13/2435* (2013.01)

(58) Field of Classification Search
CPC .. H01R 12/721; H01R 13/2435; H01R 12/73; H01R 12/737; H01R 13/6471; H01R 13/41
USPC ..... 439/637
See application file for complete search history.

(56) References Cited

U.S. PATENT DOCUMENTS 3,868,166 A * 2/1975 Ammon ..... H01R 12/716 439/634
4,286,837 A * 9/1981 Yasutake ..... H01R 43/00 439/637
5,024,609 A * 6/1991 Piorunneck ..... H01R 12/721 439/60
5,051,099 A * 9/1991 Pickles ..... H01R 12/721 439/108
5,052,936 A * 10/1991 Biechler ..... H01R 12/725 439/60
5,586,915 A * 12/1996 Baker ..... H01R 12/82 439/733.1
5,800,213 A * 9/1998 Regnier ..... H01R 12/721 439/637
5,810,623 A * 9/1998 Regnier ..... H01R 12/721 439/637

(Continued)

FOREIGN PATENT DOCUMENTS

CN 206595494 U 10/2017
CN 105633660 B 1/2019

*Primary Examiner* — Peter G Leigh
(74) *Attorney, Agent, or Firm* — Locke Lord LLP; Tim Tingkang Xia, Esq.

(57) ABSTRACT

An electrical connector includes: a first terminal with one end having a first contact and a second terminal with one end having a second contact. The first contact is located in a first accommodating hole, and a first distance exists between the first contact and an inner wall of the first accommodating hole. A width of the second contact is greater than a width of the first contact. The second contact is located in a second accommodating hole, and a second distance exists between the second contact and the inner wall of the second accommodating hole. A width of the first accommodating hole at the first contact is equal to a width of the second accommodating hole at the second contact, and the first distance is greater than the second distance.

16 Claims, 9 Drawing Sheets

(56) References Cited

U.S. PATENT DOCUMENTS 6,015,299 A * 1/2000 Walse ..... H01R 12/721 439/60
6,071,152 A * 6/2000 Achammer ..... H01R 13/41 439/733.1
6,095,821 A * 8/2000 Panella ..... H01R 13/6585 439/60
6,206,706 B1 * 3/2001 Lee ..... H01R 12/716 439/637
6,227,917 B1 * 5/2001 Chou ..... H01R 43/16 439/862
6,716,068 B2 * 4/2004 Wu ..... H01R 12/7029 439/633
6,979,228 B2 * 12/2005 Zhang ..... H01R 12/721 439/660
7,210,955 B2 * 5/2007 Ringler ..... H01R 12/585 439/381
7,481,657 B2 * 1/2009 Ng ..... H01R 13/516 439/637
7,637,783 B2 * 12/2009 Sasaoka ..... H01R 43/16 439/637
7,896,661 B2 * 3/2011 Yao ..... H01R 12/721 439/83
7,909,652 B2 * 3/2011 Yang ..... H01R 12/714 439/660
8,231,411 B1 * 7/2012 Westman ..... H01R 13/6471 439/607.05
8,342,886 B2 * 1/2013 Zhang ..... H01R 12/7005 439/660
8,353,726 B2 * 1/2013 Zhang ..... H01R 13/659 439/629
9,022,809 B2 * 5/2015 Tang ..... H01R 12/721 439/637
9,077,118 B2 * 7/2015 Szu ..... H01R 13/6585
9,281,589 B2 * 3/2016 Hsiao ..... H01R 4/04
9,281,590 B1 * 3/2016 Liu ..... H01R 13/41
9,520,678 B2 * 12/2016 Su ..... H01R 13/6477
9,608,349 B2 * 3/2017 Mashiyama ..... H01R 13/2457
9,653,848 B2 * 5/2017 Masubuchi ..... H01R 12/775
10,148,031 B2 * 12/2018 Tan ..... H01R 12/71
10,193,267 B2 * 1/2019 Tan ..... H01R 13/514
2012/0077389 A1 * 3/2012 Zhang ..... H01R 24/60 439/660
2015/0031240 A1 * 1/2015 Yang ..... H01R 13/6471 439/607.08
2015/0155665 A1 * 6/2015 Su ..... H01R 13/6477 439/676
2018/0287310 A1 * 10/2018 Fang ..... H01R 13/6581
2019/0052020 A1 * 2/2019 Chen ..... H01R 24/64

* cited by examiner

A–A

ELECTRICAL CONNECTOR HAVING REDUCED CROSSTALK WITH IMPROVED SIGNAL TRANSMISSION

CROSS-REFERENCE TO RELATED PATENT APPLICATION

This non-provisional application claims priority to and the benefit of, pursuant to 35 U.S.C. § 119(a), patent application Serial No. CN201920376838.9 filed in China on Mar. 22, 2019. The disclosure of the above application is incorporated herein in its entirety by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an electrical connector, and particularly to an electrical connector with good high-frequency performance.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

With the development of electronic devices toward high-speed signal transmission, a corresponding requirement for a signal transmission rate is also imposed on an electrical connector inside the electronic devices. A speed ranges from 3 gigabytes per second (Gb/s) to 6 Gb/s a few years ago and increases to a current speed requirement of 32 Gb/s and above. Compared with an electrical connector that transmits a signal of relatively low frequency, a connector for a high-frequency signal needs to resolve problems such as crosstalk and characteristic impedance matching. Otherwise, it is likely to generate mutual crosstalk during signal transmission, causing signal distortion.

Therefore, a heretofore unaddressed need to design a new electrical connector exists in the art to address the aforementioned deficiencies and inadequacies.

SUMMARY

The present invention is directed to an electrical connector that achieves signal terminal impedance matching by adjusting an impedance at a contact of a signal terminal.

To achieve the foregoing objective, the present invention adopts the following technical solutions.

An electrical connector includes: an insulating body, provided with a mating slot, wherein at least one side of the mating slot is provided with two accommodating holes, and the accommodating holes are in communication with the mating slot; a first terminal, wherein one end of the first terminal has a first contact, the first contact is located in a first accommodating hole of the accommodating holes, a first distance exists between the first contact and an inner wall of the first accommodating hole, the first terminal has a first extending portion located behind the first contact, the first extending portion extends out of the first accommodating hole, and the first extending portion is at least partially exposed from the first accommodating hole; and a second terminal, wherein one end of the second terminal has a second contact, a width of the second contact is greater than a width of the first contact, the second contact is located in a second accommodating hole of the accommodating holes, a second distance exists between the second contact and an inner wall of the second accommodating hole, a width of the first accommodating hole at the first contact is equal to a width of the second accommodating hole at the second contact, the first distance is greater than the second distance, the second terminal has a second extending portion located behind the second contact, the second extending portion extends out of the second accommodating hole, and the second extending portion is at least partially exposed from the second accommodating hole, wherein a third distance exists between the first extending portion and the inner wall of the first accommodating hole, a fourth distance exists between the second extending portion and the inner wall of the second accommodating hole, and the third distance is greater than the fourth distance.

In certain embodiments, a first connecting portion exists between the first contact and the first extending portion, a fifth distance existing between the first connecting portion and the inner wall of the first accommodating hole, a second connecting portion exists between the second contact and the second extending portion, a sixth distance existing between the second connecting portion and the inner wall of the second accommodating hole, and the fifth distance is equal to the sixth distance.

In certain embodiments, the first connecting portion and the second connecting portion are both elastic bending structures, and the first connecting portion and the second connecting portion both partially enter the mating slot.

In certain embodiments, the first connecting portion is forward connected to the first contact, a first flat plate fixing portion extends backward from the first connecting portion and is fixedly provided in the first accommodating hole, the first flat plate fixing portion is backward connected to the first extending portion, a width of the first flat plate fixing portion is equal to a width of a corresponding location of the first accommodating hole, the second connecting portion is forward connected to the second contact, a second flat plate fixing portion extends backward from the second connecting portion and is fixedly provided in the second accommodating hole, the second flat plate fixing portion is backward connected to the second extending portion, and a width of the second flat plate fixing portion is equal to a width of a corresponding location of the second accommodating hole.

In certain embodiments, the width of the first flat plate fixing portion is greater than a width of the first extending portion and is greater than a width of the first connecting portion, and the width of the second flat plate fixing portion is greater than a width of the second extending portion and is greater than a width of the second connecting portion.

In certain embodiments, the electrical connector includes at least two adjacent first terminals and at least two adjacent second terminals, wherein a first pitch exists between two adjacent first contacts of the at least two adjacent first terminals, a second pitch exists between two adjacent second contacts of the at least two adjacent second terminals, a third pitch exists between two adjacent first connecting portions of the at least two adjacent first terminals, a fourth pitch exists between two adjacent second connecting portions of the at least two adjacent second terminals, the second pitch is greater than the first pitch, and the fourth pitch is greater than or equal to the third pitch.

In certain embodiments, the third distance is less than the first distance, and the fourth distance is less than the second distance.

In certain embodiments, the electrical connector includes two first terminals and two second terminals respectively, wherein the two adjacent first terminals are a pair of differential signal terminals, and each of the second terminals is a ground terminal or a power terminal.

In certain embodiments, a height of the first accommodating hole at the first contact is equal to a height of the second accommodating hole at the second contact.

To achieve the foregoing objective, the present invention further adopts the following technical solutions.

An electrical connector includes: an insulating body, provided with a mating slot, wherein at least one side of the mating slot is provided with a plurality of accommodating holes, and the accommodating holes are in communication with the mating slot; at least two adjacent first terminals, each of the first terminals being a signal terminal, wherein one end of each of the first terminals has a first contact, the first contact is located in a first accommodating hole of the accommodating holes, a first distance exists between the first contact and an inner wall of the first accommodating hole, and a first pitch exists between two adjacent first contacts of the two adjacent first terminals; and at least two adjacent second terminals, each of the second terminals being a power terminal or a ground terminal, wherein one end of each of the second terminals has a second contact, the second contact is located in a second accommodating hole of the accommodating holes, a second distance exists between the second contact and an inner wall of the second accommodating hole, a width of the first accommodating hole at the first contact is equal to a width of the second accommodating hole at the second contact, the first distance is greater than the second distance, a second pitch exists between two adjacent second contacts of the two adjacent second terminals, and the second pitch is equal to the first pitch.

In certain embodiments, the two adjacent first terminals are a pair of differential signal terminals, and each of the second terminals is the ground terminal or the power terminal.

In certain embodiments, each of the first terminals has a first extending portion located behind the first contact, the first extending portion extends out of the first accommodating hole, the first extending portion is at least partially exposed from the first accommodating hole, each of the second terminals has a second extending portion located behind the second contact, the second extending portion extends out of the second accommodating hole, and the second extending portion is at least partially exposed from the second accommodating hole, a third distance exists between the first extending portion and the inner wall of the first accommodating hole, a fourth distance exists between the second extending portion and the inner wall of the second accommodating hole, and the third distance is greater than the fourth distance.

In certain embodiments, a first connecting portion exists between the first contact and the first extending portion, a fifth distance exists between the first connecting portion and the inner wall of the first accommodating hole, a second connecting portion exists between the second contact and the second extending portion, a sixth distance exists between the second connecting portion and the inner wall of the second accommodating hole, and the fifth distance is equal to the sixth distance.

In certain embodiments, the first connecting portion and the second connecting portion are both elastic bending structures, and the first connecting portion and the second connecting portion both partially enter the mating slot.

In certain embodiments, a third pitch exists between two adjacent first connecting portions of the two adjacent first terminals, a fourth pitch exists between two adjacent second connecting portions of the two adjacent second terminals, and the fourth pitch is greater than or equal to the third pitch.

In certain embodiments, a height of the first accommodating hole at the first contact is equal to a height of the second accommodating hole at the second contact.

Compared with the related art, the electrical connector according to certain embodiments of the present invention has the following beneficial effects.

The electrical connector includes the first terminal and the second terminal. One end of the first terminal includes the first contact, the first contact is located in the first accommodating hole, and the first distance exists between the first contact and the inner wall of the first accommodating hole. One end of the second terminal includes the second contact, the width of the second contact is greater than the width of the first contact, the second contact is located in the second accommodating hole, a second distance exists between the second contact and the inner wall of the second accommodating hole, and the first distance is greater than the second distance. Thus, a first hole segment at the first contact is filled with more air, and an equivalent dielectric coefficient approaches a dielectric coefficient of air. Air has a smaller dielectric coefficient, such that an impedance value at the first contact is increased, thereby meeting a matching requirement for the impedance value. In addition, because the first distance is greater than the second distance, an electric field at the first contact diverges outward, such that a density of the electric field is reduced, and performance for preventing crosstalk in high-frequency signal transmission is better, thereby reducing interference to other signal terminals.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
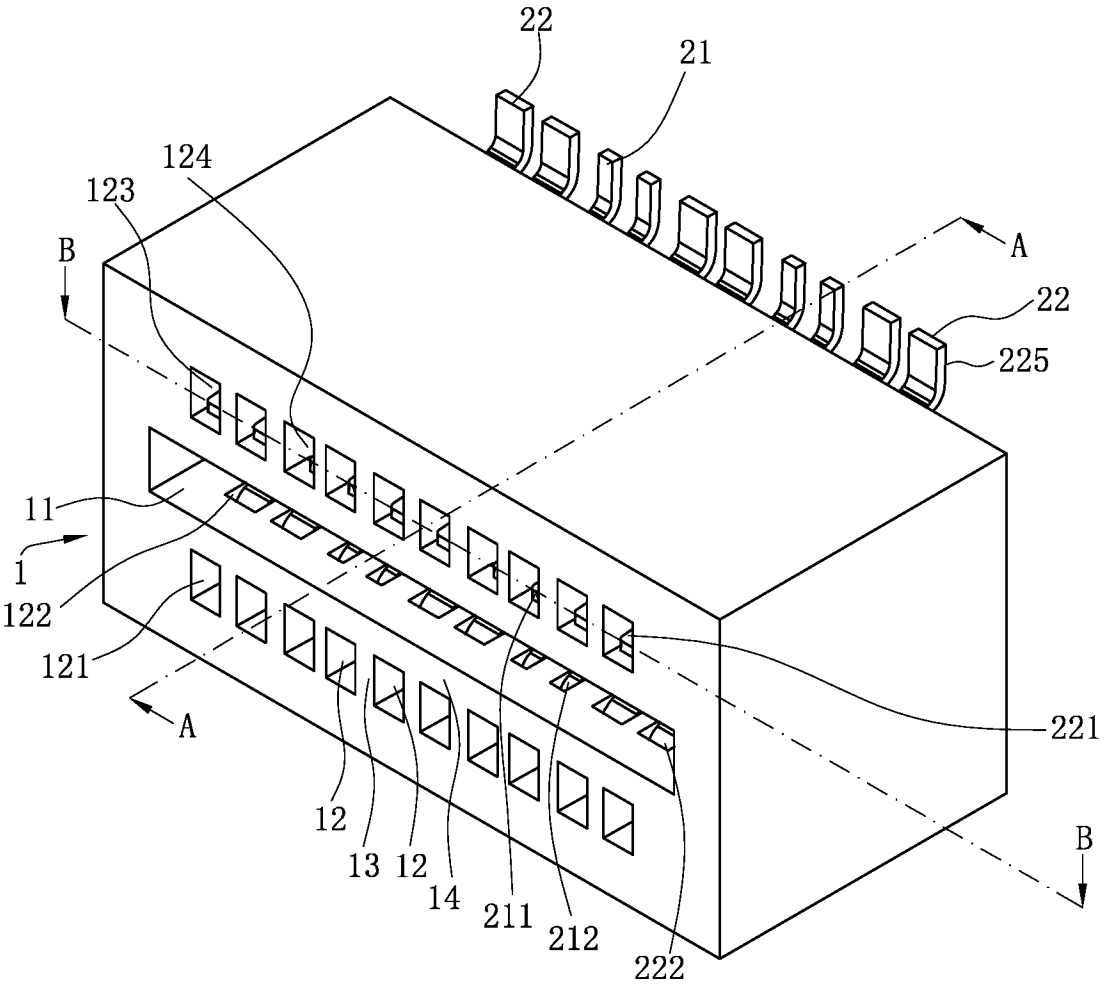
FIG. 1 is a perspective assembled view of an electrical connector according to a first embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-6. In accordance with the purposes of this invention, as embodied and broadly described herein, this invention, in one aspect, relates to an electrical connector.

Figure 2:
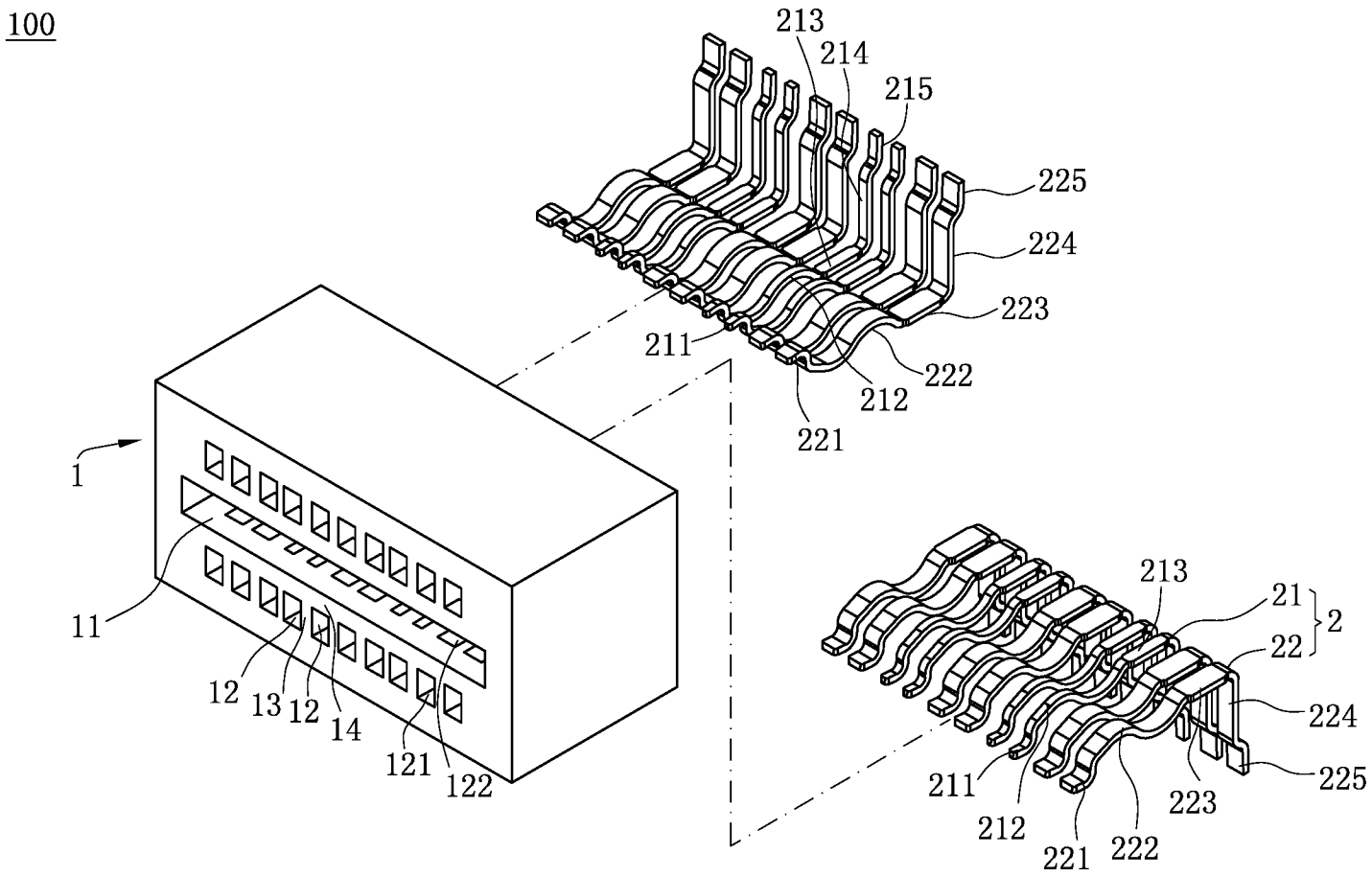
FIG. 2 is a perspective exploded view of the electrical connector according to the first embodiment of the present invention.

FIG. 1 and FIG. 2 show an electrical connector 100 according to a first embodiment of the present invention, which is used for insertion and electrical conduction of an electronic card (not shown, same below). The electrical connector 100 includes an insulating body 1, and a plurality of terminals 2 arranged in two rows are provided on the insulating body 1. The terminals 2 are assembled forward from rear thereof and extend out of the insulating body 1.

Figure 3:
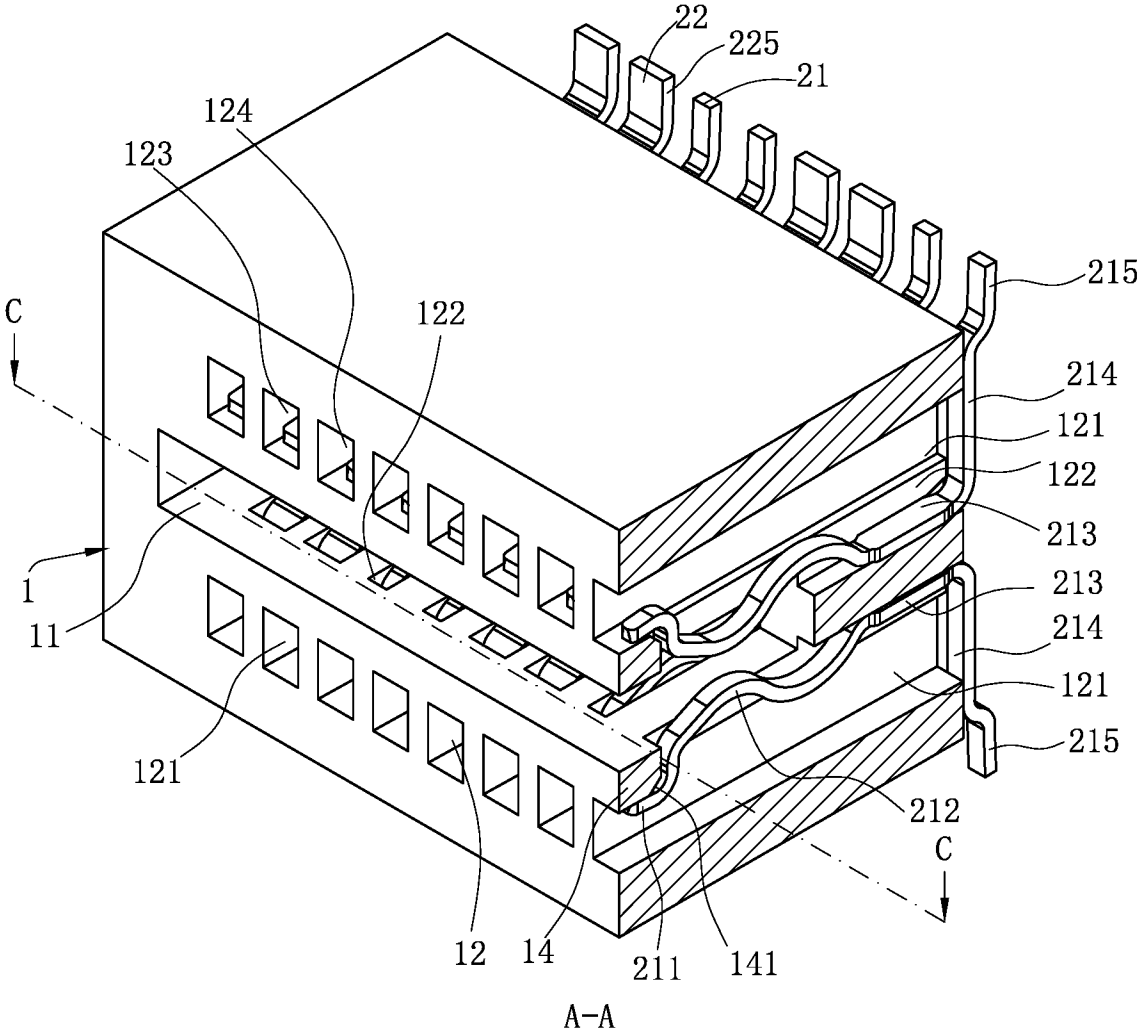
FIG. 3 is a sectional view of FIG. 1 along the A-A line.

As shown in FIG. 1, FIG. 2 and FIG. 3, a front side of the insulating body 1 is provided with a mating slot 11, and two sides of the mating slot 11 are respectively provided with multiple accommodating holes 12. The accommodating holes 12 are in communication with the mating slot 11. Each accommodating hole 12 runs through the insulating body 1 backward from the front side. A separation wall 13 exists between two adjacent accommodating holes 12 for separating the two accommodating holes 12. Each of the accommodating holes 12 has a first hole segment 121. The first hole segment 121 extends backward from the front side. A second hole segment 122 exists between the first hole segment 121 and the mating slot 11. The second hole segment 122 is in upward communication with the mating slot 11 and in downward communication with the first hole segment 121 respectively. The second hole segment 122 runs through the insulating body 1 backward. The terminals 2 are respectively located in multiple first hole segments 121 of the accommodating holes 12, and at least partially pass through the second hole segments 122 of the accommodating holes 12 to be exposed from the mating slot 11. The electronic card is plugged into the mating slot 11, and is in electrical contact with the terminals 2 exposed from the mating slot 11. In addition, the second hole segment 122 does not run through the insulating body 1 forward, and a position limiting portion 14 is provided at a front end of the second hole segment 122 close to the insulating body 1. The position limiting portion 14 is located between the first hole segment 121 and the mating slot 11. The position limiting portion 14 is provided with a chamfer 141 at a location in which the first hole segment 121 is in communication with the second hole segment 122 to facilitate assembly of the terminal 2.

Figure 4:
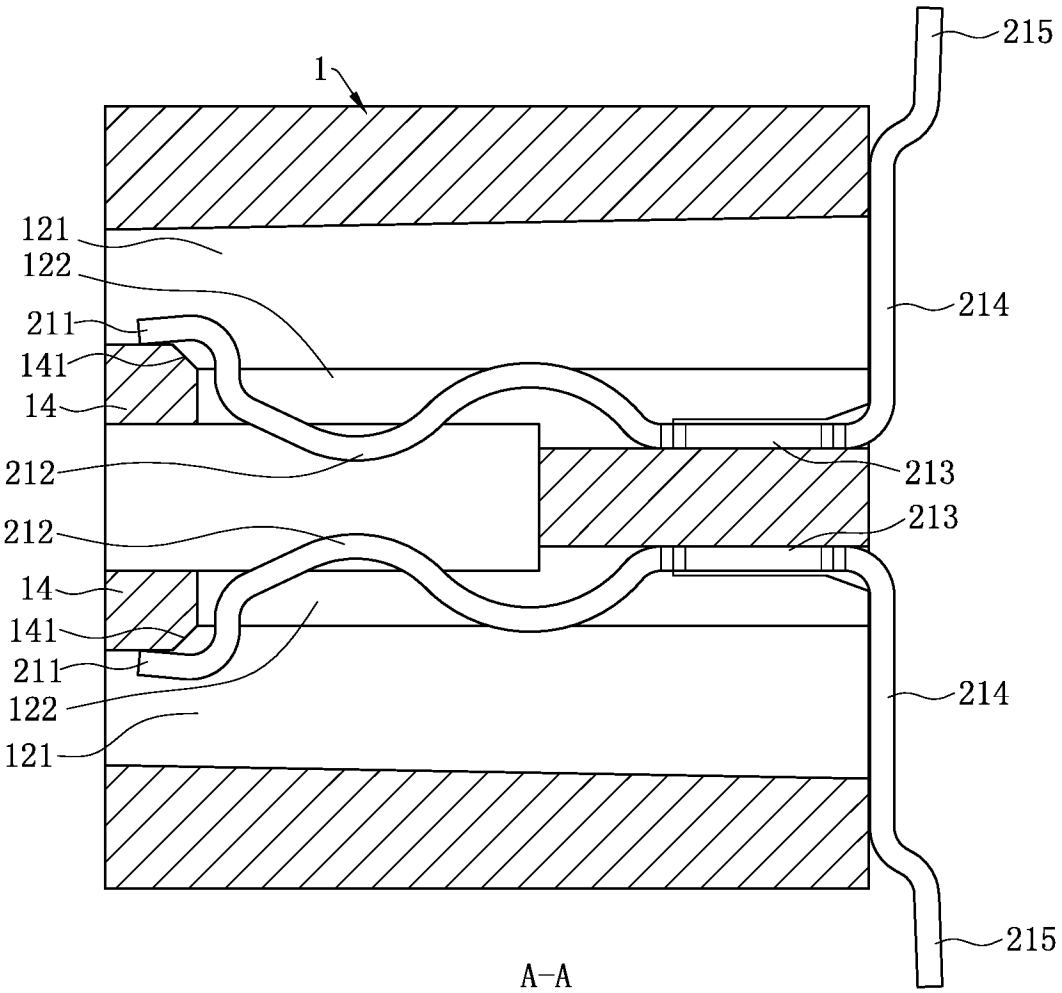
FIG. 4 is a sectional view of FIG. 1 along the A-A line from another viewing angle.
Figure 5:
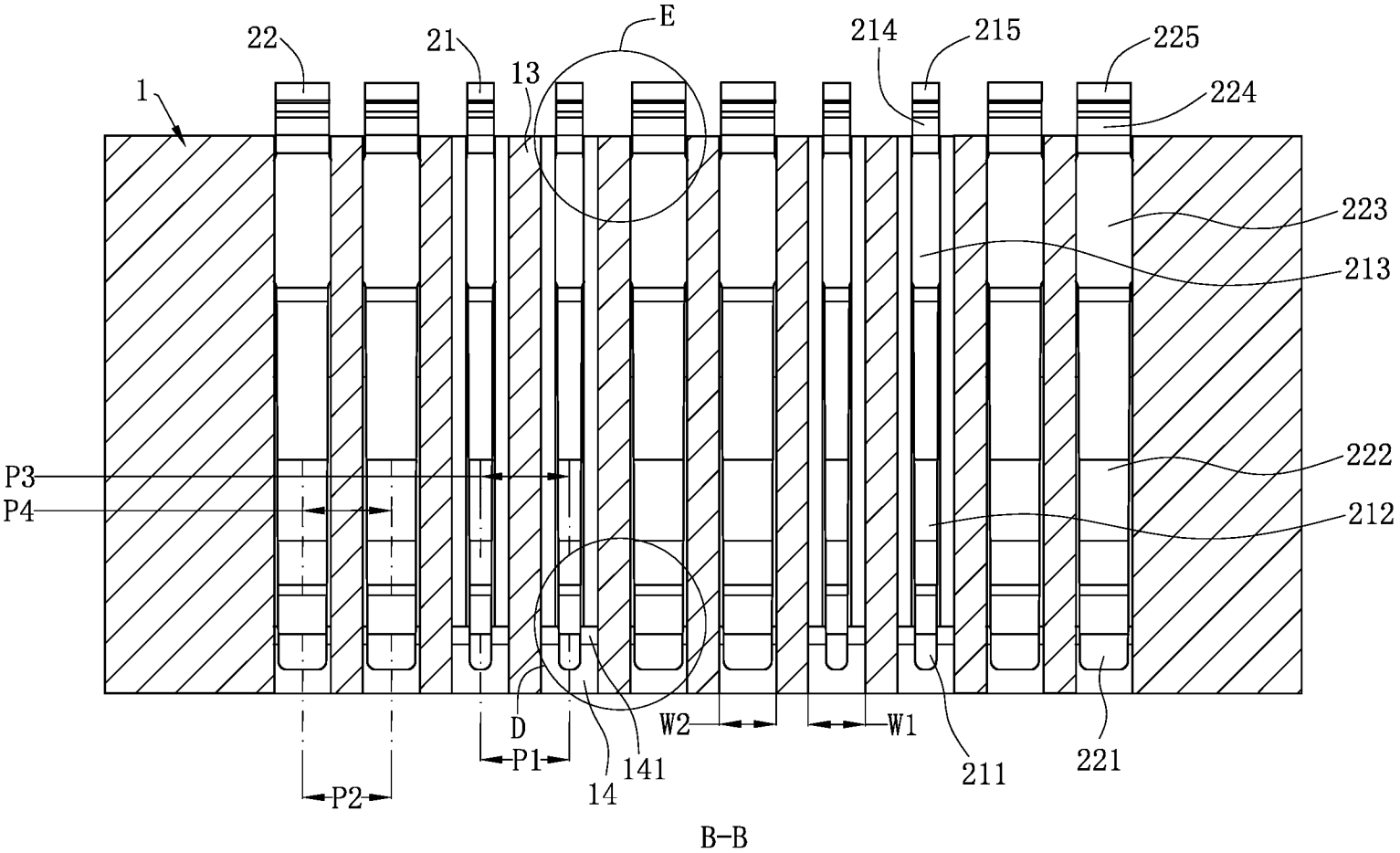
FIG. 5 is a sectional view of FIG. 1 along the B-B line.

As shown in FIG. 3, FIG. 4 and FIG. 5, multiple terminals 2 in an upper row and multiple terminals 2 in a lower row are symmetrically provided. The terminals 2 in each row include multiple first terminals 21 and multiple second terminals 22. The first terminals 21 are signal terminals, and the second terminals 22 are power terminals, ground terminals, detection terminals, or the like. For explanation purposes, the accommodating hole 12 corresponding to each of the first terminals 21 is referred to as the first accommodating hole 123, and the accommodating hole 12 corresponding to each of the second terminals 22 is referred to as the second accommodating hole 124. A front end of each of the first terminals 21 has a first contact 211. The first contact 211 is provided in the first hole segment 121 of the corresponding first accommodating hole 123, and the first hole segment 121 has a width W1 at the first contact 211. The first contact 211 is limited by the position limiting portion 14 of the corresponding first accommodating hole 123, to prevent the first contact 211 from entering the mating slot 11 and affecting mating, while preventing the first contact 211 from being broken when the electronic card is inserted into the mating slot 11. A front end of each of the second terminals 22 has a second contact 221. The second contact 221 is provided in the first hole segment 121 of the corresponding second accommodating hole 124, and the first hole segment 121 has a width W2 at the second contact 221. The width W1 of the first hole segment 121 at the first contact 211 is equal to the width W2 of the first hole segment 121 at the second contact 221, and a height of the first hole segment 121 at the first contact 211 is equal to a height of the first hole segment 121 at the second contact 221. The second contact 221 is limited by the position limiting portion 14 of the corresponding second accommodating hole 124, to prevent the second contact 221 from entering the mating slot 11 and affecting mating, while preventing the second contact 221 from being broken when the electronic card is inserted into the mating slot 11.

Figure 7:
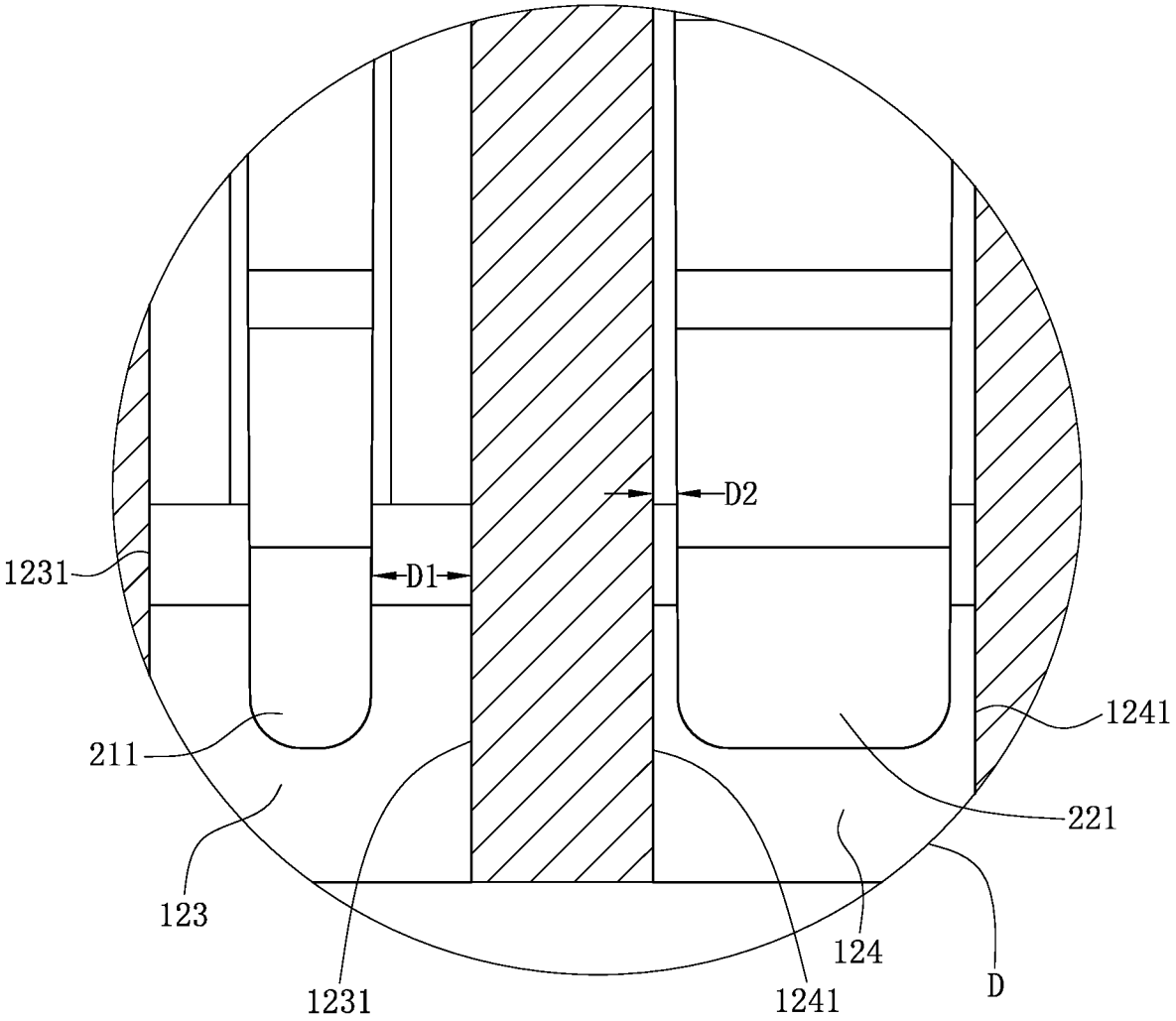
FIG. 7 is an enlarged view of a portion D in FIG. 5.

A first pitch P1 exists between two adjacent first contacts 211 of two adjacent first terminals 21, and a second pitch P2 exists between two adjacent second contacts 221 of two adjacent second terminals 22. The first pitch P1 is equal to the second pitch P2. As shown in FIG. 7, in a left-right direction, a first distance D1 exists between the first contact 211 and an inner wall 1231 of the corresponding first hole segment 121 of the corresponding first accommodating hole 123, and a second distance D2 exists between the second contact 221 and the inner wall 1241 of the corresponding first hole segment 121 of the corresponding second accommodating hole 124. A width of the second contact 221 is greater than a width of the first contact 211, such that the first distance D1 is greater than the second distance D2, the first hole segment 121 at the first contact 211 is filled with more air, and an equivalent dielectric coefficient approaches a dielectric coefficient of air. In addition, air has a smaller dielectric coefficient, such that an impedance value at the first contact 211 is increased, thereby meeting a matching requirement for the impedance value. Further, because the first distance D1 is greater than the second distance D2, an electric field at the first contact 211 diverges outward, such that a density of the electric field is reduced, and performance for preventing crosstalk in high-frequency signal transmission is better, thereby reducing interference to other signal terminals.

Figure 9:
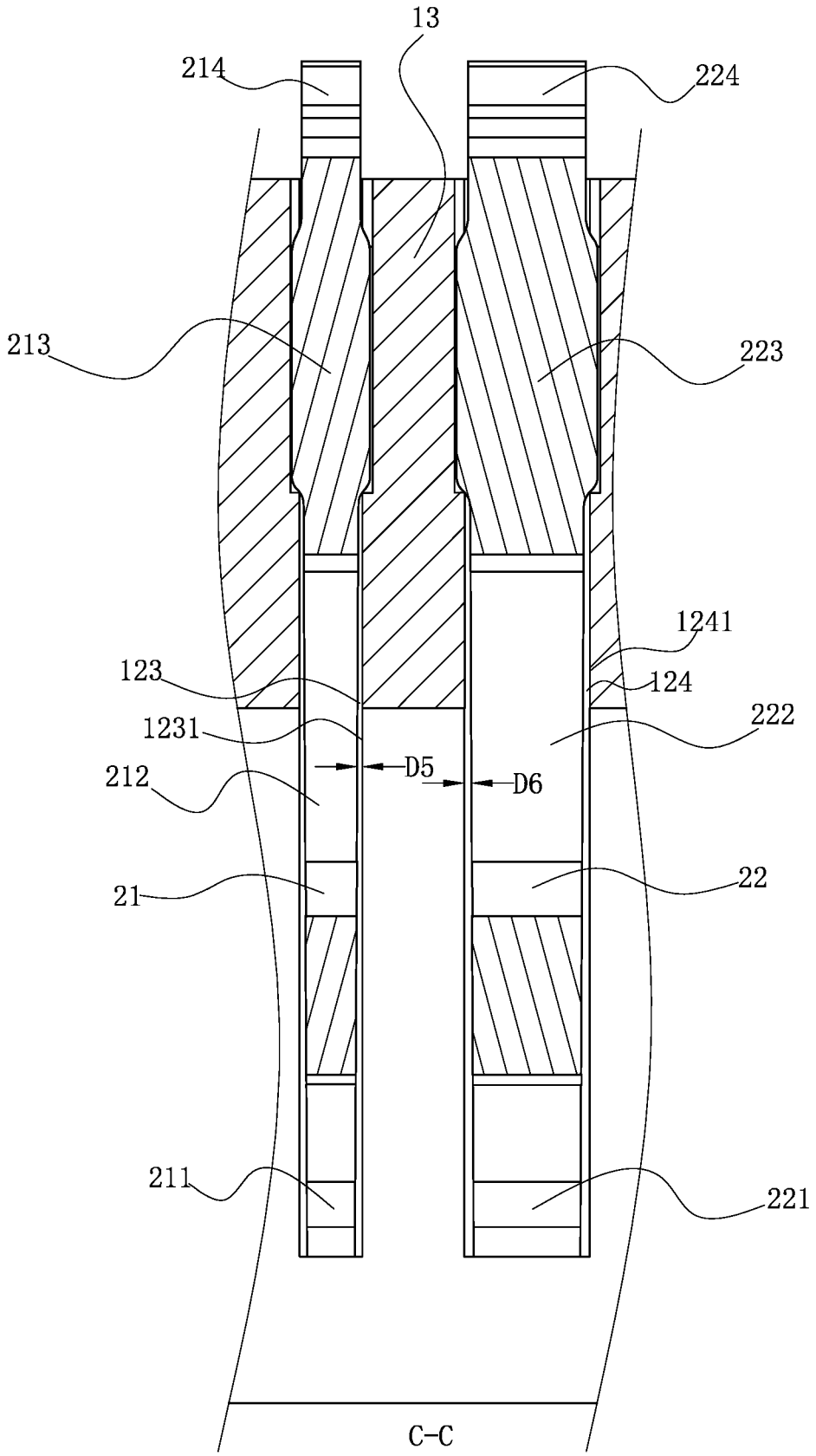
FIG. 9 is a partially enlarged sectional view of FIG. 3 along the C-C line.

A first connecting portion 212 and a second connecting portion 222 extend backward from the first contact 211 and the second contact 221 respectively. The first connecting portion 212 and the second connecting portion 222 are respectively provided in the second hole segments 122 of the corresponding first accommodating holes 123 and the corresponding second accommodating holes 124, and partially enter the mating slot 11 to electrically contact the electronic card. As shown in FIG. 9, a fifth distance D5 exists between the first connecting portion 212 and an inner wall 1231 of the corresponding second hole segment 122 of the corresponding first accommodating hole 123, and a sixth distance D6 exists between the second connecting portion 222 and an inner wall 1241 of the corresponding second hole segment 122 of the corresponding second accommodating hole 124. The separation wall 13 is thickened at the second hole segment 122 corresponding to the first terminal 21, such that the fifth distance is equal to the sixth distance, and a withstand voltage between two adjacent first connecting portions 212 is increased. Further, when a relatively large current is passing through the first terminal 21, the current cannot break down the separation wall 13 easily, thereby avoiding short-circuiting between the two adjacent first terminals 21.

In other embodiments, the two adjacent first terminals 21 may be a pair of differential signal terminals. In this case, the first connecting portion 212 may also be widened relative to the first contact 211, such that the fifth distance D5 is equal to the sixth distance D6, thereby reducing a contact impedance at the first connecting portion 212 and improving stability of docking between the first connecting portion 212 and the electronic card. Further, the two adjacent first connecting portions 212 are widened, such that a distance between the two first connecting portions 212 is smaller, and contacts of the differential signal terminals are tightly coupled, thereby improving anti-interference performance of the differential signal terminal and reducing signal interference to other terminals.

A third pitch P3 exists between two adjacent first connecting portions 212 of the two adjacent first terminals 21, and a fourth pitch P4 exists between two adjacent second connecting portions 222 of the two adjacent second terminals 22. The third pitch P3 is equal to the fourth pitch P4. Further, the first pitch P1 is equal to the third pitch P3, and the second pitch P2 is equal to the fourth pitch P4, such that signal transmission is smoother.

In other embodiments, the second connecting portions 222 of the two adjacent power terminals may also be provided away from each other, such that the fourth pitch P4 is greater than the third pitch P3, and a relatively large current does not break down the separation wall 13 when passing through the power terminal. The second connecting portions 222 of the two adjacent ground terminals may also be provided away from each other, such that the fourth pitch P4 is greater than the third pitch P3, thereby preventing signal interference between the two adjacent ground terminals, and adjusting the impedance value.

The first connecting portion 212 and the second connecting portion 222 are both elastic bending structures and formed by bending twice in opposite directions. In this way, elasticity of the first connecting portion 212 and the second connecting portion 222 can be effectively improved. When the electronic card is inserted into the mating slot 11, under an abutting action of the electronic card, the first connecting portion 212 and the second connecting portion 222 elastically move upward or downward relative to the electronic card. In this case, both a location at which the first connecting portion 212 and the electronic card contact and a location at which the second connecting portion 222 and the electronic card contact move backward, such that an effective transmission path of a signal is shortened.

A first flat plate fixing portion 213 and a second flat plate fixing portion 223 extend backward from the first connecting portion 212 and the second connecting portion 222 respectively. The first flat plate fixing portion 213 and the second flat plate fixing portion 223 are respectively fixedly provided in the corresponding second hole segments 122 of the corresponding first accommodating holes 123 and the corresponding second accommodating holes 124. A width of the first flat plate fixing portion 213 is substantially the same as that of a corresponding location in the second hole segment 122, and the first flat plate fixing portion 213 is fixed just right to the corresponding second hole segment 122. A width of the second flat plate fixing portion 223 is substantially the same as a width of a corresponding location in the second hole segment 122, and the second flat plate fixing portion 223 is fixed just right to the corresponding second hole segment 122. In this way, it can also be ensured that the first connecting portion 212 and the second connecting portion 222 elastically abut the electronic card accurately.

The width of the first flat plate fixing portion 213 is greater than the width of the first connecting portion 212, and the width of the second flat plate fixing portion 223 is greater than the width of the second connecting portion 222. A first extending portion 214 and a second extending portion 224 extend from the first flat plate fixing portion 213 and the second flat plate fixing portion 223 respectively through bending backward. The width of the first flat plate fixing portion 213 is greater than the width of the first connecting portion 212 and a width of the first extending portion 214, and the width of the second flat plate fixing portion 223 is greater than the width of the second connecting portion 222 and a width of the second extending portion 224. Further, the second hole segments 122 of the corresponding first accommodating holes 123 and the corresponding second accommodating holes 124 are widened correspondingly at the first flat plate fixing portion 213 and the second flat plate fixing portion 223, thereby preventing air from easily entering therein, adjusting an impedance downward, and reducing loss of signal transmission.

Figure 6:
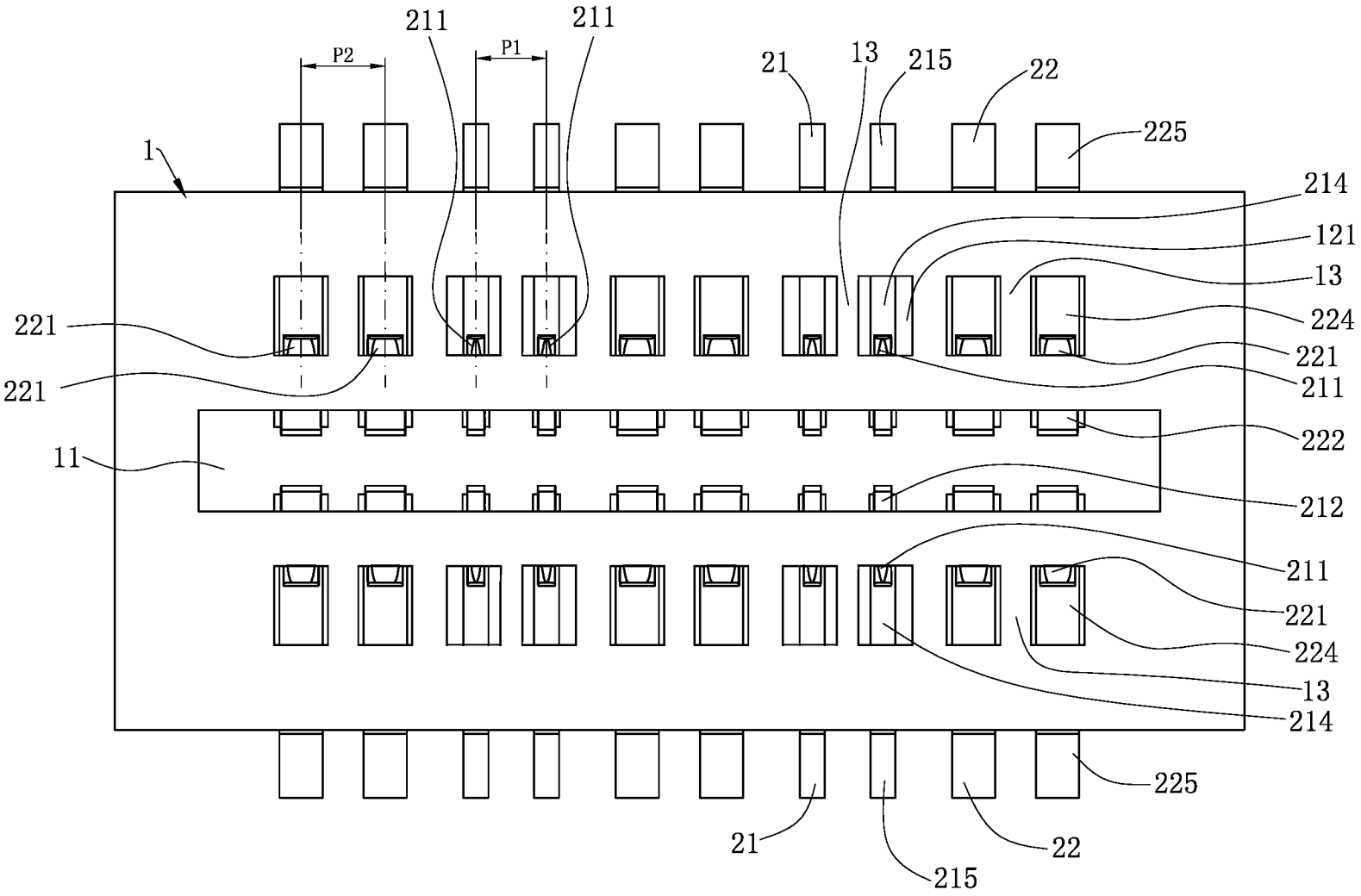
FIG. 6 is a schematic view of an electrical connector according to a second embodiment of the present invention.
Figure 8:
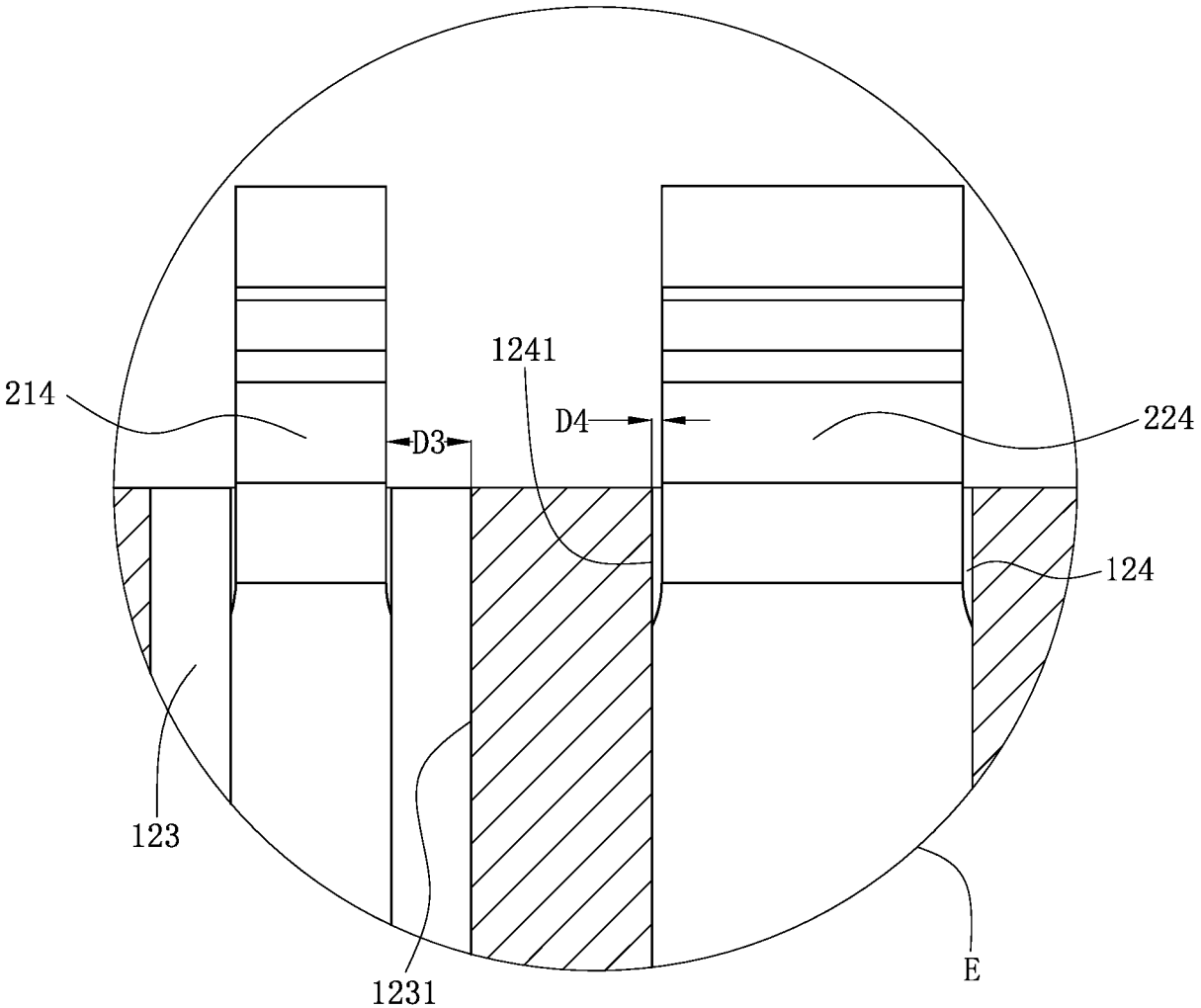
FIG. 8 is an enlarged view of a portion E in FIG. 5.

The first extending portion 214 and the second extending portion 224 extend out of the corresponding first accommodating holes 123 and the corresponding second accommodating holes 124 through the second hole segments 122 thereof. The first extending portion 214 and the first flat plate fixing portion 213 are perpendicular to each other, and the second extending portion 224 and the second flat plate fixing portion 223 are perpendicular to each other. As shown in FIG. 6, a front plate surface of the first extending portion 214 is exposed from the first hole segment 121 of the corresponding first accommodating hole 123, and a front plate surface of the second extending portion 224 is exposed from the first hole segment 121 of the corresponding second accommodating hole 124. As shown in FIG. 8, a third distance D3 exists between the first extending portion 214 and an inner wall 1231 of the corresponding first hole segment 121 of the corresponding first accommodating hole 123, and a fourth distance D4 exists between the second extending portion 224 and an inner wall 1241 of the corresponding first hole segment 121 of the corresponding second accommodating hole 124. The third distance D3 is greater than the fourth distance D4. Therefore, the first hole segment 121 at the first extending portion 214 is filled with more air, and an equivalent dielectric coefficient approaches a dielectric coefficient of the air. In addition, air has a smaller dielectric coefficient, such that an impedance value at the first extending portion 214 is increased, thereby meeting a matching requirement for the impedance value.

The first extending portion 214 is widened relative to the first contact 211, and the second extending portion 224 of the second terminal 22 is widened relative to the second contact 221, such that the third distance D3 is less than the first distance D1, and the fourth distance D4 is less than the second distance D2. In this way, the first extending portion 214 can be closer to the second extending portion 224. Further, the second terminal 22 is a ground terminal, and the first terminal 21 is protected using the ground terminal to improve anti-interference performance of a signal.

A first contact portion 215 and a second contact portion 225 respectively extend backward from the first extending portion 214 and the second extending portion 224, and the first contact portion 215 and the second contact portion 225 are respectively in contact with lines on a circuit board (not shown, same below) to achieve electrical conduction.

FIG. 6 shows an electrical connector 100 according to a second embodiment of the present invention, which is different from the first embodiment in that: a thickness of the separation wall 13 between the two adjacent first terminals 21 at the first hole segment 121 is less than a thickness of the separation wall 13 between the two adjacent second terminals 22 at the first hole segment 121. Alternatively, the thickness of the separation wall 13 between the two adjacent first terminals 21 at the first hole segment 121 is less than a thickness of the separation wall 13 between the first terminal 21 and the second terminal 22 at the first hole segment 121. Meanwhile, the two adjacent first terminals 21 are close to each other. In this way, the second pitch P2 is greater than the first pitch P1, and the fourth pitch P4 is greater than the third pitch P3. The two adjacent first terminals 21 are a pair of differential signal terminals, and multiple pairs of differential signal terminals are provided, such that an effect of differential coupling between the differential signal terminal pairs can be improved, thereby helping reduce crosstalk and signal loss. The first pitch P1 is equal to the third pitch P3, and the second pitch P2 is equal to the fourth pitch P4, such that signal transmission is smoother.

In other embodiments, the first contacts 211 of the two adjacent first terminals 21 are close to each other, such that the second pitch P2 is greater than the first pitch P1. However, the first connecting portions 212 are provided away from each other, such that the fourth pitch P4 is equal to the third pitch P3, and the impedance value at the first connecting portion 212 is increased, thereby meeting the matching requirement for the impedance value. Other contents in the second embodiment are identical to those in the first embodiment, and details thereof are not further elaborated herein.

To sum up, the electrical connector 100 according to certain embodiments of the present invention have the following beneficial effects:

(1) The width W1 of the first hole segment 121 at the first contact 211 is greater than the width W2 of the first contact hole segment 121 at the second contact 221, and the width of the second contact 221 is greater than the width of the first contact 211. Therefore, the first distance D1 is greater than the second distance D2, such that the first hole segment 121 at the first contact 211 is filled with more air, and the equivalent dielectric coefficient approaches the dielectric coefficient of air. In addition, air has a smaller dielectric coefficient, such that the impedance value at the first contact 211 is increased, thereby meeting the matching requirement for the impedance value. Further, because the first distance D1 is greater than the second distance D2, an electric field at the first contact 211 diverges outward, such that a density of the electric field is reduced, and performance for preventing crosstalk in high-frequency signal transmission is better, thereby reducing interference to other signal terminals.

(2) The third distance D3 is greater than the fourth distance D4, such that the first hole segment 121 at the first extending portion 214 is filled with more air, and the equivalent dielectric coefficient approaches a dielectric coefficient of air. In addition, air has a smaller dielectric coefficient, such that the impedance value at the first extending portion 214 can be increased, thereby meeting the matching requirement for the impedance value.

(3) The thickness of the separation wall 13 between the two adjacent first terminals 21 at the first hole segment 121 is less than the thickness of the separation wall 13 between the two adjacent second terminals 22 at the first hole segment 121. Alternatively, the thickness of the separation wall 13 between the two adjacent first terminals 21 at the first hole segment 121 is less than the thickness of the separation wall 13 between the first terminal 21 and the second terminal 22 at the first hole segment 121. Meanwhile, the two adjacent first terminals 21 are close to each other, such that the second pitch P2 is greater than the first pitch P1, and the fourth pitch P4 is greater than the third pitch P3. The two adjacent first terminals 21 are a pair of differential signal terminals, such that an effect of differential coupling between the differential signal terminal pairs can be improved, thereby helping reduce crosstalk and signal loss. The first pitch P1 is equal to the third pitch P3, and the second pitch P2 is equal to the fourth pitch P4, such that signal transmission is smoother.

The first contacts 211 of the two adjacent first terminals 21 are close to each other, such that the second pitch P2 is greater than the first pitch P1. However, the first connecting portions 212 are provided away from each other, such that the fourth pitch P4 is equal to the third pitch P3, and the impedance value at the first connecting portion 212 is increased, thereby meeting the matching requirement for the impedance value.

(4) The width of the second flat plate fixing portion 223 is greater than the width of the second connecting portion 222 and a width of the second extending portion 224. Further, the second hole segments 122 of the corresponding first accommodating holes 123 and the corresponding second accommodating holes 124 are widened correspondingly at the first flat plate fixing portion 213 and the second flat plate fixing portion 223, thereby preventing air from easily entering therein, adjusting an impedance downward, and reducing loss of signal transmission.

(5) The first extending portion 214 is widened relative to the first contact 211, and the second extending portion 224 of the second terminal 22 is widened relative to the second contact 221, such that the third distance D3 is less than the first distance D1, and the fourth distance D4 is less than the second distance D2. In this way, the first extending portion 214 can be closer to the second extending portion 224. Further, the second terminal 22 is a ground terminal, and the first terminal 21 is protected using the ground terminal to improve anti-interference performance of a signal.

(6) The first pitch P1 is equal to the second pitch P2, and the third pitch P3 is equal to the fourth pitch P4. In addition, the first pitch P1 is equal to the third pitch P3, and the second pitch P2 is equal to the fourth pitch P4, such that signal transmission is smoother.

The first pitch P1 is equal to the second pitch P2, and the second connecting portions 222 of the two adjacent power terminals are provided away from each other, such that the fourth pitch P4 is greater than the third pitch P3, and a relatively large current does not break down the separation wall 13 when passing through the power terminal. Alternatively, the second connecting portions 222 of the two adjacent ground terminals are provided away from each other, such that the fourth pitch P4 is greater than the third pitch P3, thereby preventing signal interference between the two adjacent ground terminals, and adjusting the impedance value.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, comprising:

an insulating body, provided with a mating slot, wherein at least one side of the mating slot is provided with at least two accommodating holes, and the accommodating holes are in communication with the mating slot; and at least one first terminal, being a signal terminal, and at least one second terminal, being a power terminal or a ground terminal, wherein the first terminal and the second terminal are located at a same side of the mating slot and are arranged along an arrangement direction, one end of the first terminal has a first contact, the first contact is located in a first accommodating hole of the accommodating holes, a first distance exists between the first contact and an inner wall of the first accommodating hole along the arrangement direction of the first terminal and the second terminal, the first terminal has a first extending portion located behind the first contact, the first extending portion extends out of the first accommodating hole, the first extending portion is at least partially exposed from the first accommodating hole, one end of the second terminal has a second contact, a width of the second contact is greater than a width of the first contact, the second contact is located in a second accommodating hole of the accommodating holes, a second distance exists between the second contact and an inner wall of the second accommodating hole along the arrangement direction of the first terminal and the second terminal, a width of the first accommodating hole at the first contact is equal to a width of the second accommodating hole at the second contact, the first distance is greater than the second distance, the second terminal has a second extending portion located behind the second contact, the second extending portion extends out of the second accommodating hole, and the second extending portion is at least partially exposed from the second accommodating hole, wherein a third distance exists between the first extending portion and the inner wall of the first accommodating hole along the arrangement direction of the first terminal and the second terminal, a fourth distance exists between the second extending portion and the inner wall of the second accommodating hole along the arrangement direction of the first terminal and the second terminal, and the third distance is greater than the fourth distance.

2. The electrical connector according to claim 1, wherein a first connecting portion exists between the first contact and the first extending portion, a fifth distance existing between the first connecting portion and the inner wall of the first accommodating hole along the arrangement direction of the first terminal and the second terminal, a second connecting portion exists between the second contact and the second extending portion, a sixth distance existing between the second connecting portion and the inner wall of the second accommodating hole, and the fifth distance is equal to the sixth distance along the arrangement direction of the first terminal and the second terminal.

3. The electrical connector according to claim 2, wherein the first connecting portion and the second connecting portion are both elastic bending structures, and the first connecting portion and the second connecting portion both partially enter the mating slot.

4. The electrical connector according to claim 2, wherein the first connecting portion is forward connected to the first contact, a first flat plate fixing portion extends backward from the first connecting portion and is fixedly provided in the first accommodating hole, the first flat plate fixing portion is backward connected to the first extending portion, a width of the first flat plate fixing portion is equal to a width of a corresponding location of the first accommodating hole, the second connecting portion is forward connected to the second contact, a second flat plate fixing portion extends backward from the second connecting portion and is fixedly provided in the second accommodating hole, the second flat plate fixing portion is backward connected to the second extending portion, and a width of the second flat plate fixing portion is equal to a width of a corresponding location of the second accommodating hole.

5. The electrical connector according to claim 4, wherein the width of the first flat plate fixing portion is greater than a width of the first extending portion and is greater than a width of the first connecting portion, and the width of the second flat plate fixing portion is greater than a width of the second extending portion and is greater than a width of the second connecting portion.

6. The electrical connector according to claim 2, further comprising at least two adjacent first terminals and at least two adjacent second terminals, wherein the at least two adjacent first terminals and the at least two adjacent second terminals are all located at a same side of the mating slot, a first pitch exists between two adjacent first contacts of the at least two adjacent first terminals, a second pitch exists between two adjacent second contacts of the at least two adjacent second terminals, a third pitch exists between two adjacent first connecting portions of the at least two adjacent first terminals, a fourth pitch exists between two adjacent second connecting portions of the at least two adjacent second terminals, the second pitch is greater than or equal to the first pitch, and the fourth pitch is greater than or equal to the third pitch.

7. The electrical connector according to claim 1, wherein the third distance is less than the first distance, and the fourth distance is less than the second distance.

8. The electrical connector according to claim 1, comprising two first terminals and two second terminals respectively, wherein the two adjacent first terminals are a pair of differential signal terminals, and each of the second terminals is a ground terminal or a power terminal.

9. The electrical connector according to claim 1, wherein a height of the first accommodating hole at the first contact is equal to a height of the second accommodating hole at the second contact.

10. An electrical connector, comprising:

an insulating body, provided with a mating slot, wherein at least one side of the mating slot is provided with a plurality of accommodating holes, and the accommodating holes are in communication with the mating slot;

at least two adjacent first terminals arranged in an arrangement direction, each of the first terminals being a signal terminal, wherein one end of each of the first terminals has a first contact, the first contact is located in a first accommodating hole of the accommodating holes, a first distance exists between the first contact and an inner wall of the first accommodating hole along the arrangement direction of the first terminals, and a first pitch exists between two adjacent first contacts of the two adjacent first terminals; and at least two adjacent second terminals arranged in an arrangement direction, each of the second terminals being a power terminal or a ground terminal, and the arrangement direction of the first terminals and the arrangement direction of the second terminals being identical or parallel to each other, wherein the at least two adjacent first terminals and the at least two adjacent second terminals are all located at a same side of the mating slot, one end of each of the second terminals has a second contact, the second contact is located in a second accommodating hole of the accommodating holes, a second distance exists between the second contact and an inner wall of the second accommodating hole along the arrangement direction of the second terminals, a width of the first accommodating hole at the first contact is equal to a width of the second accommodating hole at the second contact, the first distance is greater than the second distance, a second pitch exists between two adjacent second contacts of the two adjacent second terminals, and the second pitch is equal to the first pitch.

11. The electrical connector according to claim 10, wherein the two adjacent first terminals are a pair of differential signal terminals, and each of the second terminals is the ground terminal or the power terminal.

12. The electrical connector according to claim 10, wherein each of the first terminals has a first extending portion located behind the first contact, the first extending portion extends out of the first accommodating hole, the first extending portion is at least partially exposed from the first accommodating hole, each of the second terminals has a second extending portion located behind the second contact, the second extending portion extends out of the second accommodating hole, and the second extending portion is at least partially exposed from the second accommodating hole, a third distance exists between the first extending portion and the inner wall of the first accommodating hole along the arrangement direction of the first terminals, a fourth distance exists between the second extending portion and the inner wall of the second accommodating hole along the arrangement direction of the second terminals, and the third distance is greater than the fourth distance.

13. The electrical connector according to claim 12, wherein a first connecting portion exists between the first contact and the first extending portion, a fifth distance exists between the first connecting portion and the inner wall of the first accommodating hole along the arrangement direction of the first terminals, a second connecting portion exists between the second contact and the second extending portion, a sixth distance exists between the second connecting portion and the inner wall of the second accommodating hole along the arrangement direction of the second terminals, and the fifth distance is equal to the sixth distance.

14. The electrical connector according to claim 13, wherein the first connecting portion and the second connecting portion are both elastic bending structures, and the first connecting portion and the second connecting portion both partially enter the mating slot.

15. The electrical connector according to claim 13, wherein a third pitch exists between two adjacent first connecting portions of the two adjacent first terminals, a fourth pitch exists between two adjacent second connecting portions of the two adjacent second terminals, and the fourth pitch is greater than or equal to the third pitch.

16. The electrical connector according to claim 10, wherein a height of the first accommodating hole at the first contact is equal to a height of the second accommodating hole at the second contact.

* * * * *